US005901480A

United States Patent [19]

Shamblin

[11] Patent Number: 5,901,480

[45] Date of Patent: May 11, 1999

[54] REINFORCED LOADER BUCKET STRUCTURE

[75] Inventor: Wayne A. Shamblin, Fort Worth, Tex.

[73] Assignee: G.H. Hensley Industries, Inc., Dallas, Tex.

[21] Appl. No.: 08/993,805

[22] Filed: Dec. 18, 1997

[51] Int. Cl.[6] ..... E02F 3/40

[52] U.S. Cl. ..... 37/444; 37/404; 414/722

[58] Field of Search ..... 37/403, 404, 444, 37/443; 414/685, 722, 724

[56] References Cited

U.S. PATENT DOCUMENTS

| | | | |
|---|---|---|---|
| Re. 29,603 | 4/1978 | Oke et al. | 214/145 R |
| T981,001 | 4/1979 | McReynolds | 37/118 R |
| 2,783,903 | 3/1957 | Beyerstedt | 214/140 |
| 3,853,232 | 12/1974 | Oke et al. | 214/145 |
| 3,896,569 | 7/1975 | Thompson et al. . | |
| 4,086,712 | 5/1978 | McReynolds | 37/118 A |
| 4,395,193 | 7/1983 | Christensen et al. | 414/722 |
| 4,523,397 | 6/1985 | Lucas | 37/118 R |
| 4,939,855 | 7/1990 | McCreary, Jr. | 37/103 |
| 5,267,402 | 12/1993 | Russell et al. | 37/118 A |
| 5,425,189 | 6/1995 | Anderson et al. . | |
| 5,695,310 | 12/1997 | Foster et al. . | |

*Primary Examiner*—Heather Shackelford
*Attorney, Agent, or Firm*—Konneker & Smith, P.C.

[57] ABSTRACT

An earthworking loader bucket has a specially designed bottom side reinforcement structure which includes a unitary base plate member extending rearwardly from the bottom side front bucket lip and having a front side edge welded to the rear side edge of the lip. Slots are formed in the rear side edge of the base plate and receive bottom end portions of plate-shaped lifting and tilt ears transversely welded to the curved rear side wall of the bucket. Closeout plates are interposed between the bucket rear side wall and rear side portions of the base plate, and the bottom end portions of the ears are welded to the base plate. A spaced plurality of elongated ear extension members longitudinally extend forwardly from the ear member bottom end portions and along adjacent bottom side portions of the base plate and lip, with the extension members being welded to the ear member bottom end portions, the base plate and the lip. The ear extension members function to transfer ear operating loads to bottom side portions of the base plate and the lip, to substantially reinforce the bottom side of the bucket, and also serve as downwardly projecting wear runners to shield bottom side portions of the base plate and lip against abrasion wear.

15 Claims, 2 Drawing Sheets

REINFORCED LOADER BUCKET STRUCTURE

BACKGROUND OF THE INVENTION

The present invention generally relates to material handling bucket structures and, in a preferred embodiment thereof, more particularly relates to a specially designed reinforced bucket structure for use with a loader vehicle such as a wheeled loader.

A conventionally constructed loader bucket used in earth working operations is typically attached to the lower end of a lift arm which, in turn, is operatively connected to a wheeled loader. This type of loader bucket is of a rugged, all-metal construction, with an open front side, and has a bottom wall (referred to in the industry as a "lip"). The front side edge of the lip has a spaced series of forwardly projecting adapter structures to which replaceable digging tooth points may be removably connected, and the lip has a straight rear side edge. A curved, relatively thin rear side wall of the bucket is positioned opposite its open front side. Extending rearwardly from the straight rear side edge of the lip is a multi-piece rear bottom wall structure, with edge portions of the individual pieces of the bottom wall structure being welded to the rear side edge of the lip.

Secured to the curved rear side wall of the loader bucket, and extending rearwardly therefrom, are two or more pairs of lifting ears which are spaced apart from each other in a direction parallel to the rear side edge of the bucket lip. The lifting ear pairs are positioned on opposite sides of a pair or more of tilt ears which are also secured to he curved rear side wall of the loader bucket and extend rearwardly therefrom. The lifting ear pairs, and the tilt ears disposed therebetween, are pivotally connected by pins to the lift arm, with the two pairs of lifting ears being used to lift and lower the bucket relative to the ground, and the central tilt ears being used to selectively pivot the bucket about the lifting ear pins during earthworking use of the loader bucket.

In a conventionally constructed loader bucket of this general type, bottom side portions of the lifting ears are secured to the rear side wall of the bucket and the rear side edge of the lip, but the tilt ears are secured only to the curved rear side wall of the bucket at points spaced well rearwardly of the rear side edge of the bucket lip.

Two primary problems are presented by this conventional loader bucket construction. First, because of the many separate pieces used to form the rear bottom wall structure, the bucket is tedious and relatively expensive to manufacture. Second, particularly during the exertion of "prying" forces on the bucket (i.e., forcibly pivoting the bucket rearwardly and upwardly while a front portion of its lip is embedded in the earth), the previously described conventional connection of the lifting and tilt ears to the balance of the bucket structure tends to cause premature cracking failure along a bottom side portion of the bucket generally aligned with the tilt ears—usually along a crack line transverse to the rear side edge of the bucket lip.

As can be seen from the foregoing, a need exists for an improved loader bucket construction which eliminates or at least substantially reduces the above-mentioned problems associated with conventionally constructed loader buckets of the general type described. It is to this need to which the present invention is directed.

SUMMARY OF THE INVENTION

In carrying out principles of the present invention, in accordance with a preferred embodiment thereof, a specially designed reinforced loader bucket is provided which has a hollow body with an open front side, a curved rear side wall, a pair of opposite end walls, and a front lip member extending along a bottom side of the rear side wall and having a rear side edge. A spaced series of adapter structures are preferably mounted on the front side edge of the lip member and are configured to removably receive replaceable excavating tooth points.

A base plate structure, preferably a unitary base plate member, extends rearwardly from the bucket lip and has a front side edge anchored to the rear side edge of the lip, and a rear side edge in which a spaced plurality of slots are formed. The slots longitudinally extend toward the rear side edge of the lip member.

A spaced plurality of generally plate-shaped lifting and tilt ear structures are transversely anchored to the rear side wall. The ear structures have end portions which are received in the base plate member slots and are anchored to the base plate member, and elongated extension portions longitudinally extending from the ear structure end portions forwardly across and being anchored to adjacent bottom side portions of the base plate member and lip member.

These extension portions are preferably separate structures anchored to the ear structure end portions and laterally project downwardly , function to (1) distribute lip operating loads to the adjacent bottom side portions of the base plate and the ear structure, to thereby substantially reduce the possibility that a central bottom portion of the bucket will be cracked due to prying loads imposed on the bucket, and (2) shield at least portions of the bottom sides of the base plate and lip from abrasion wear.

In a preferred embodiment of the loader bucket, closeout plates are interdigitated with the ear members and are anchored between the rear side wall of the bucket and rear portions of the base plate, and the base plate is provided with rearwardly projecting tab portions to which suitable heel pads may be secured. The spaced plurality of lifting and tilt ear structures preferably include a first spaced pair of lifting ear structures, a second spaced pair of lifting ear structures spaced apart from the first spaced pair of lifting ear structures, and a spaced pair of tilt ear structures positioned between the first and second spaced pairs of lifting ear structures. Representatively, the lifting and tilt ear structures have openings therein for receiving boom arm retaining members to operatively couple the bucket to excavating apparatus such as, for example, a wheeled loader vehicle.

DETAILED DESCRIPTION

Figure 1:
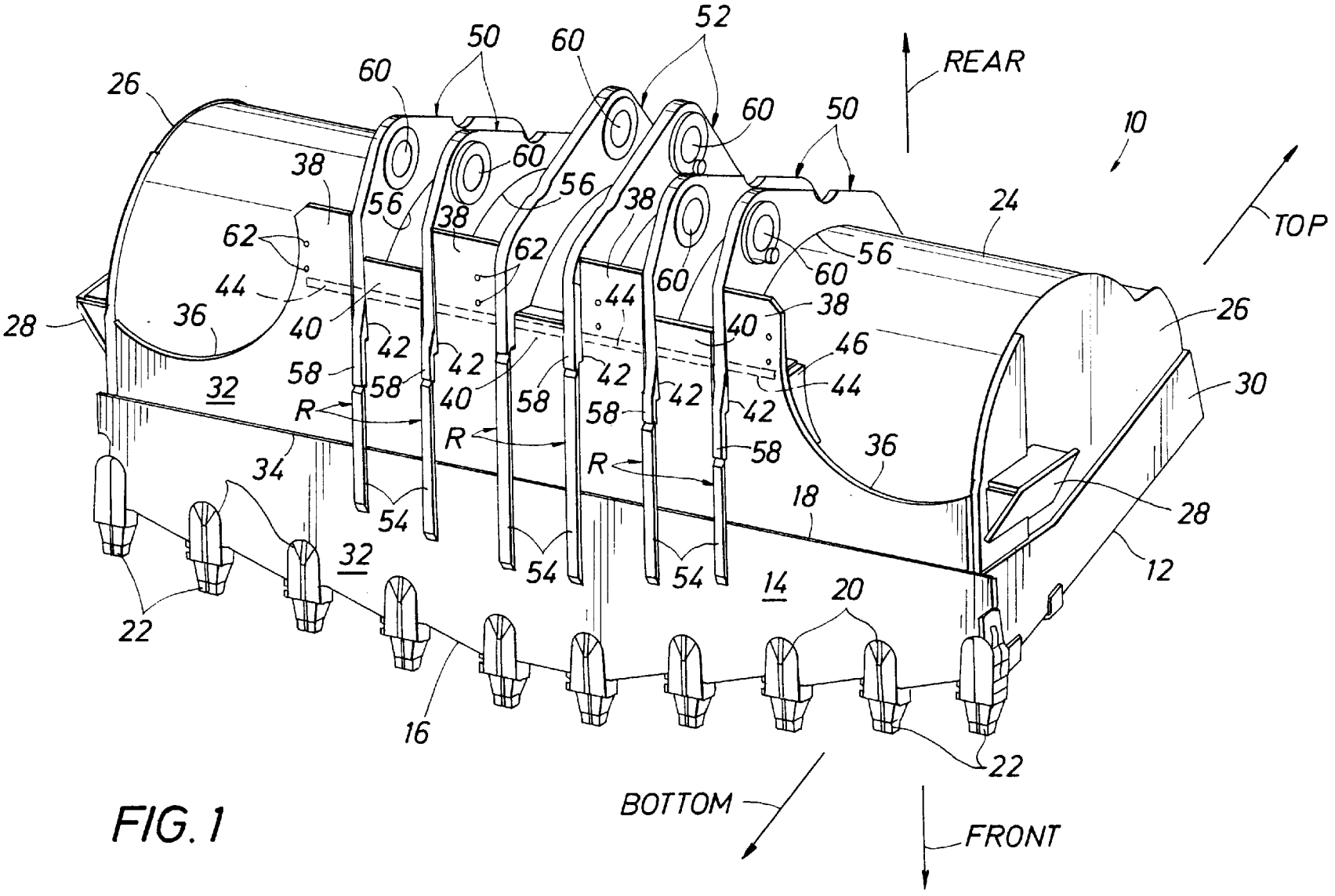
FIG. 1 is a bottom rear side perspective view of a specially designed reinforced earthworking loader bucket embodying principles of the present invention.
Figure 2:
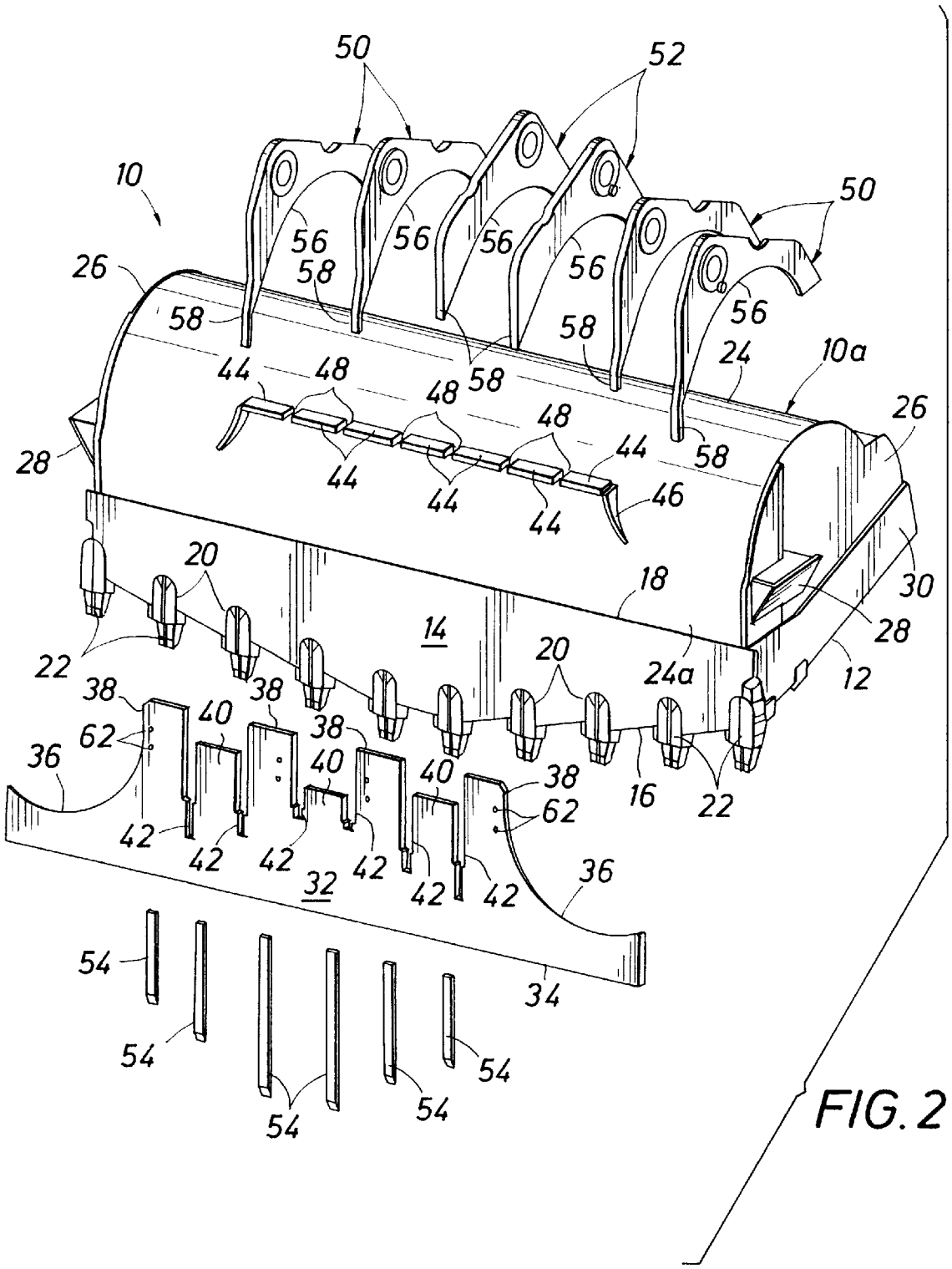
FIG. 2 is a reduced scale partially exploded perspective view of the loader bucket.

Perspectively illustrated in FIGS. 1 and 2 is a specially designed reinforced earthworking loader bucket 10 embodying principles of the present invention. Bucket 10 is of a rugged, all-metal construction and is designed to be used in conjunction with an excavating vehicle (not illustrated herein) such as, for example, a wheeled loader having a lift arm with a lower end portion to which the bucket 10 may be attached as later described herein.

The loader bucket 10 has an open front side 12, and a generally planar bottom wall or "lip" 14 having a sloping front side edge 16 and a straight rear side edge 18. A spaced series of conventional adapter structures 20 are secured to the lip 14 and project forwardly beyond its front side edge 16. The adapters 20 have forwardly projecting nose portions 22 that are receivable in replaceable excavating tooth points (not shown) in a conventional manner. Extending rearwardly from the lip 14 is a curved, relatively thin rear side wall 24 which defines the closed rear side of the loader bucket 10. End walls 26 are welded to the opposite ends of the rear side wall 24 and have conventional rock deflectors 28 secured thereto along with forwardly disposed blade plates 30.

According to a key feature of the present invention, a unitary base plate member 32 is provided which, like the lip 14 has a generally planar configuration. Base plate 32 has a straight front side edge 34, and an irregularly shaped rear side edge with arcuate end portions 36, and a forwardly and rearwardly stepped central portion formed by four rearwardly projecting tabs 38 and three rearwardly projecting shorter tabs 40 interdigitated with the four tabs 38. Tabs 38 and 40 are laterally separated from one another by slots 42 which extend forwardly into the rear side edge of the unitary base plate member 32.

For purposes later described herein, seven generally rectangular closeout plates 44 are spaced apart in a row parallel to the rear side edge 18 of the lip 14 and have side edges welded to the outer side of the rear side wall 24, somewhat rearwardly of the lip 14, so that they project downwardly from the rear side wall 24. Also welded to the rear side wall 24, at the opposite ends of the row of rectangular closeout plates 44, are a pair of curved closeout end plates 46. As best illustrated in FIG. 2, each adjacent pair of rectangular closeout plates 44 has a gap 48 therebetween.

The improved reinforced loader bucket 10 also includes two pairs of lifting ear members 50, a pair of tilt ear members 52, and six elongated ear extension members 54. Ear members 50,52 have elongated, generally plate-like configurations, arcuate inner side edges 56 that conform to the curvature of the rear side wall 24, forwardly projecting bottom end portions 58, and reinforced circular connection openings 60 in longitudinally central portions thereof.

In assembling the loader bucket 10, a bucket subassembly 10*a* formed (see FIG. 2) prior to the installation of the ears 50 and 52, the closeout plates 44 and 46, the base plate 32 and the ear extension members 54. The bucket subassembly 10*a* includes the lip 14, the rear side wall 24, the end walls 26, the rock deflectors 28 and the blade plates 30.

Next, the lifting and tilt ear members 50 and 52 are installed on the subassembly 10*a* by positioning the pair of tilt ears 52 between the two pairs of lifting ears 50 in a central rear portion of the bucket wall 24, as shown in FIG. 1, and then welding the curved inner side edges 56 of the ears to the outer side surface of the wall 24, with the ear member bottom end portions 58 extending transversely toward the rear side edge 18 of the lip 14. After the lifting and tilt ear members 50,52 have been welded to the rear bucket side wall 24 in this manner, the closeout plates 44,46 are welded to the rear side wall 24 (as can best be seen in FIG. 2), with the ear member end portions 58 being positioned in the plate gaps 48 so that the ear member end portions 58 are interdigitated with the closeout plates 44 as shown in phantom in FIG. 1.

Then, the unitary base plate member 32 is positioned as shown in FIG. 1 on the bottom side of the partially completed bucket structure, with the front side edge 34 of the base plate 32 abutting the rear side edge 18 of the lip 14, the base plate 32 being generally coplanar with the lip 14, and the ear member end portions being received in the corresponding base plate slots 42 to thereby interlock the ear member end portions 58 with the unitary base plate member 32. After the base plate member 32 is positioned in this manner it is anchored in place by welding the front side edge 34 of the base plate 32 to the rear side edge 18 of the lip 14; welding the opposite end portions of the base plate 32 to the essentially flat front side portion 24*a* of the rear side wall 24 (see FIG. 2); welding the base plate tabs 38,40 to the underlying closeout plates 44,46; and welding the ear member end portions 58 to the slots 42 in the base plate 32.

As can be seen in FIG. 1, adjacent the front ends of the closeout end plates 44 the rear side wall 24 of the bucket 10 begins to curve rearwardly away from the generally planar base plate 32, thereby forming a gap between the rear bucket side wall 24 and the base plate tabs 38,40. The ear member end portions 58 extend forwardly into this gap, to form with the tabs 38,40 and an overlying portion of the wall 24 a reinforcing box section, with the open rear periphery of such gap being sealed off by the closeout plates 44 and 46 to keep dirt out of the gap. As illustrated in FIG. 1, bottom side sections of the ear end portions 58 project downwardly beyond the bottom side of the installed base plate member 32.

Finally, as illustrated in FIG. 1, the ear extension members 54 are welded to the bottom side of the base plate 32 and the lip 14 in an orientation in which an end of each extension member 54 abuts a front end of an associated ear member bottom end portion 58, with the extension members 54 longitudinally extending perpendicularly to the rear side edge 18 of the lip 14 and forwardly across the side edge 18 onto the bottom side of the lip 14. Additionally, the rear ends of the extension members 54 are welded to the front ends of the ear member portions 58.

To attach the completed bucket 10 to its associated loader vehicle, the lower ends of the vehicle's two lift arms are inserted between the pairs of lifting ears 50 on opposite sides of the tilt ears 52, and a suitable retaining pin structure is passed through the facing pairs of lifting ear openings 50 and through the inserted lower lifting arm ends. In a similar manner, the end of the boom's bucket link arm is inserted between the tilt ears 52 and a retaining pin is passed through the aligned openings 60 in the tilt ears and a corresponding opening in the bucket link arm. During earthworking operations using the installed bucket 10, the lifting arms are used to raise and lower the bucket 10 relative to the earth, and the bucket link arm is used to forwardly and rearwardly pivot the bucket 10 relative to the lower ends of the lifting arms.

By virtue of the use of the unitary base plate 32 the manufacturing cost of the bucket 10 compared to conventionally configured loader buckets is substantially reduced because less handling and welding time is required. Additionally, due to the unique interlocking between the base plate 32 and the ears 50,52 and the use of the ear extensions 54 which tie all of the ears to both the lip 14 and the base plate 32 the bucket 10 is greatly strengthened compared to conventionally constructed loader buckets.

As mentioned previously herein, a primary failure mode of such conventionally constructed loader buckets is a central bottom side stress crack typically resulting from the high bottom side bending forces created during a "prying" use of the bucket—i.e., when the front edge of the lip 14 is embedded in the earth, and the bucket is being forcibly pivoted rearwardly and upwardly. In the reinforced loader bucket 10 of the present invention, however, this bending force is very strongly resisted via the tying of both the lifting ears 50 and the tilt ears 52 to both the base plate 32 and the lip 14 to thereby distribute such prying loads instead of concentrating the prying load on the curved rear side wall 24 and lip joint.

As can be seen in FIG. 1, the ear extension members 54 form forward continuations of the downwardly protruding side sections of the bottom ear member end portions 58 and define therewith elongated runners R that laterally project downwardly from the bottom sides of both the base plate 32 and the lip 14. These runners R advantageously have a dual function in the assembled loader bucket 10. First, as described above, they serve to spread the operating loads imposed on the ears 50 and 52 to both the unitary base plate 32 and the lip 14, thereby shielding the curved rear side wall 24 from operating load damage.

Second, they serve as sacrificial wear members that at least partially shield the undersides of the base plate 32 and lip 14 from abrasion damage during earthworking operations. This shielding may be augmented, if desired, by attaching conventional heel pads (not shown) to rear underside portions of the longer base plate tabs 38 using mounting holes 62 formed therein. As illustrated, the elongated ear extension members 54 are preferably separate elements which are welded onto the front ends of the bottom ear member end portions 58 as opposed to being integral therewith. Because of this, after the extension members 54 become substantially worn down from operational abrasion they may be simply be removed (using, for example, a cutting torch) and replaced with new extension members welded to the bucket in their place.

The foregoing detailed description is to be clearly understood as being given by way of illustration and example only, the spirit and scope of the present invention being limited solely by the appended claims.

What is claimed is:

1. A loader bucket comprising:

a hollow body having an open front side, a rear side wall, a pair of opposite end walls, and a front lip member extending along a bottom side of said rear side wall and having a rear side edge;

a base plate structure extending rearwardly from said lip member, said base plate structure having a front side edge anchored to said rear side edge of said lip member, and a rear side edge in which a spaced plurality of slots are formed and extend toward said rear side edge of said lip member; and a spaced plurality of generally plate-shaped lifting and tilt ear structures transversely anchored to said rear side wall, said ear structures having end portions received in said slots and anchored to said base plate member, and elongated extension portions longitudinally extending from said end portions forwardly across and being anchored to adjacent bottom side portions of said base plate member and said lip member and being operative to distribute ear structure operating loads to said adjacent bottom side portions of said base plate member and said lip member, and to shield at least portions of the bottom sides of said base plate member and said lip member from abrasion wear.

2. The loader bucket of claim 1 wherein said base plate structure is a unitary base plate member.

3. The loader bucket of claim 1 further comprising a spaced series of closeout plate members interdigitated with said end portions of said lifting and tilt ear structures, and extending between and being transversely secured to said rear side wall and rear portions of said base plate structure.

4. The loader bucket of claim 3 wherein said base plate structure has tab portions extending rearwardly past said closeout plate members and being configured for attachment thereto of heel pad structures.

5. The loader bucket of claim 1 wherein:

said lip member has a front side edge, and said loader bucket further comprises a plurality of adapter structures spaced apart along said front side edge of said lip member and configured to removably support a plurality of replaceable tooth point members.

6. The loader bucket of claim 1 wherein at least portions of said ear structure end portions have side sections projecting downwardly beyond said base plate structure.

7. The loader bucket of claim 6 wherein said elongated exterior portions of said lifting and tilt ear structures are separate elongated extension members anchored at ends thereof to facing portions of said end portions of said lifting and tilt ear structures.

8. The loader bucket of claim 1 wherein said spaced plurality of lifting and tilt ear structures include a first spaced pair of lifting ear structures, a second spaced pair of lifting ear structures spaced apart from said first spaced pair of lifting ear structures, and a spaced pair of tilt ear structures positioned between said first and second spaced pairs of lifting ear structures.

9. The loader bucket of claim 8 wherein said lifting ear structures and said tilt ear structures have openings therein for receiving boom arm and linkage retaining members.

10. A loader bucket comprising:

a hollow body having an open front side, a rear side wall, a pair of opposite end walls, and a front lip member extending along a bottom side of said rear side wall and having a rear side edge;

a unitary base plate member extending rearwardly from said lip member, said base plate member having a front side edge anchored to said rear side edge of said lip member, and a rear side edge having formed therein a spaced plurality of slots extending therethrough toward said rear side edge of said base plate member;

a spaced plurality of lifting and tilt ear members anchored to said rear side wall and having bottom end portions received in said slots and anchored to said base plate member, said bottom end portions having side sections projecting downwardly beyond said base plate member;

a spaced plurality of closeout members interposed between rear portions of said base plate member, being interdigitated with said bottom end portions, and being anchored to said base plate member and said rear side wall; and a spaced plurality of elongated ear extension members longitudinally extending forwardly from forward ends of said side sections of said bottom end portions along bottom side portions of said base plate member and said lip member, said ear extension members being anchored to said base plate member, said lip member and said forward ends of said side sections of said ear member bottom end portions.

11. The loader bucket of claim 10 wherein said unitary base plate member has tab portions extending rearwardly past said closeout plate members and being configured for attachment thereto of heel pad structures.

12. The loader bucket of claim 10 wherein:

said lip member has a front side edge, and said loader bucket further comprises a plurality of adapter structures spaced apart along said front side edge of said lip member and configured to removably support a plurality of replaceable tooth point members.

13. The loader bucket of claim 10 wherein said spaced plurality of lifting and tilt ear members include a first spaced pair of lifting ear members, a second spaced pair of lifting ear members spaced apart from said first spaced pair of lifting ear members, and a spaced pair of tilt ear members positioned between said first and second spaced pairs of lifting ear members.

14. The loader bucket of claim 13 wherein said lifting ear members and said tilt ear members have generally plate-like configurations and extend generally transversely to said rear side wall.

15. The loader bucket of claim 14 wherein said lifting ear members and said tilt ear members have openings therein for receiving boom arm and linkage retaining members.

* * * * *

UNITED STATES PATENT AND TRADEMARK OFFICE

CERTIFICATE OF CORRECTION

PATENT NO. : 5,901,480

DATED : May 11, 1999

INVENTOR(S) : Wayne A. Shamblin

It is certified that error appears in the above-indentified patent and that said Letters Patent is hereby corrected as shown below:

Column 6, line 15, "exterior" should be --extension--.

Signed and Sealed this

Twenty-third Day of November, 1999

*Attest:*

Q. TODD DICKINSON

*Attesting Officer*

*Acting Commissioner of Patents and Trademarks*